US008418748B2

(12) United States Patent
Wagstaff et al.

(10) Patent No.: US 8,418,748 B2
(45) Date of Patent: Apr. 16, 2013

(54) CASTING COMPOSITE INGOT WITH METAL TEMPERATURE COMPENSATION

(75) Inventors: Robert Bruce Wagstaff, Greenacres, WA (US); Aaron David Sinden, Valleyford, WA (US); Todd F. Bischoff, Spokane Valley, WA (US); Eric Ball, Spokane, WA (US); Jeff McDermott, Liberty Lake, WA (US)

(73) Assignee: Novelis Inc., Toronto, Ontario (CA)

( * ) Notice: Subject to any disclaimer, the term of this patent is extended or adjusted under 35 U.S.C. 154(b) by 50 days.

(21) Appl. No.: 12/931,724

(22) Filed: Feb. 9, 2011

(65) Prior Publication Data

US 2011/0198050 A1 Aug. 18, 2011

Related U.S. Application Data

(60) Provisional application No. 61/337,611, filed on Feb. 11, 2010.

(51) Int. Cl.
*B22D 11/00* (2006.01)
*B22D 11/16* (2006.01)

(52) U.S. Cl.
USPC ..... 164/461; 164/487; 164/452

(58) Field of Classification Search ..... 164/461, 164/487, 437, 444, 452, 455
See application file for complete search history.

(56) References Cited

U.S. PATENT DOCUMENTS

| | | | | |
|---|---|---|---|---|
| 3,478,808 A | | 11/1969 | Adams | |
| 4,235,276 A | | 11/1980 | Gilles et al. | |
| 4,693,298 A | * | 9/1987 | Wagstaff | 164/486 |
| 4,949,777 A | * | 8/1990 | Itoyama et al. | 164/453 |
| 5,839,500 A | | 11/1998 | Roder et al. | |
| 6,089,309 A | | 7/2000 | Ge | |
| 6,260,602 B1 | | 7/2001 | Wagstaff | |
| 2005/0011630 A1 | | 1/2005 | Anderson et al. | |

FOREIGN PATENT DOCUMENTS

| | | |
|---|---|---|
| EP | 1 567 296 B1 | 8/2005 |
| WO | WO 2004/112992 A2 | 12/2004 |

OTHER PUBLICATIONS

Canadian Intellectual Property Office, International Search Report, May 9, 2011 PCT/CA2011/000145 (Novelis Inc. et al.).
"International Alloy Designations and Chemical Composition Limits for Wrought Aluminum and Wrought Aluminum Alloys" published by the Aluminum Associate, Inc., revised Feb. 2009.

* cited by examiner

*Primary Examiner* — Kevin P Kerns
*Assistant Examiner* — Steven Ha
(74) *Attorney, Agent, or Firm* — Cooper & Dunham LLP

(57) ABSTRACT

An exemplary embodiment of the invention provides a method of direct chill casting a composite metal ingot. The method involves sequentially casting two or more metal layers to form a composite ingot by supplying streams of molten metal to two or more casting chambers within a casting mold of a direct chill casting apparatus. Inlet temperatures of one or more of the streams of molten metal are monitored at a position adjacent to an inlet of a casting chamber fed with the stream, and the inlet temperatures are compared with a predetermined set temperature for the stream to determine if there is any difference. A casting variable that affects molten metal temperatures entering or within the casting chambers (e.g. casting speed) is then adjusted by an amount based on the difference of the compared temperatures to eliminate adverse casting effects caused by the difference of the inlet temperature and the set temperature. Preferably an adjustment is selected that causes the monitored temperature to approach the set temperature. Another exemplary embodiment provides equipment for operation of the method.

15 Claims, 7 Drawing Sheets

CASTING COMPOSITE INGOT WITH METAL TEMPERATURE COMPENSATION

CROSS-REFERENCE TO RELATED APPLICATION

This application claims the priority right of prior co-pending U.S. provisional patent application Ser. No. 61/337,611 filed on Feb. 11, 2010 by applicants named herein. The entire contents of application Ser. No. 61/337,611 are specifically incorporated herein by this reference for all purposes.

BACKGROUND OF THE INVENTION

I. Field of the Invention

This invention relates to the casting of composite metal ingots by sequential direct chill casting. More particularly, the invention relates to such casting in which compensation is made for variations of the input temperatures of molten metals being cast.

II. Background Art

It is desirable for many purposes to cast metal ingots made of two or more metal layers. For example, rolled products produced from such ingots may be formed with a metal coating layer on one or both sides of a core layer in order to provide specific surface properties that may differ from the bulk properties of the metal product. A very desirable way in which such composite ingots may be cast is disclosed in International Patent publication no. WO 2004/112992 naming Anderson et al. as inventors. This publication discloses a method of, and apparatus for, direct chill (DC) casting two or more metal layers at one time to form a composite ingot. For good adhesion between the metal layers, it is desirable to ensure that the layers, while being cast together in a single apparatus, are formed sequentially so that molten metal of one layer contacts previously-cast semi-solid metal of another layer, thereby allowing a degree of metal co-diffusion across the metal-metal interface(s). The casting arrangement may also prevent undue oxide formation at the interface(s) between the metal layers, again improving mutual adhesion of the layers.

It has been found by the inventors named herein that the temperatures of the molten metals used for the casting of various layers can affect the operation of the casting method and apparatus. If one or more of the metal streams is too hot, rupture or other kind of failure of the metal-metal interface where the metals first come into contact may occur as the ingot is being formed. On the other hand, if one or more of the metal streams is too cold, the flow of molten metal into the casting mold can be hindered due to partial or complete freezing of the metal in downspouts or distribution troughs used for conveying the metals to the casting mold. Additionally, in such cases, pre-solidified material may be delivered to the casting mold itself which adversely affects the cast product. While the apparatus is generally optimized to deliver metals to the mold at desired temperatures (referred to as a "set point" for a particular metal), it is not always easy in practice to maintain the desired temperatures due to environmental factors and unexpected operational variations. It is therefore desirable to provide a way of negating or minimizing the adverse effects of such temperature variations.

While the above-mentioned International patent publication to Anderson et al. discloses a basic process for co-casting multiple layers to form composite ingots, the problems caused by variations of input temperatures are not discussed or disclosed and no solutions are discussed.

U.S. Pat. No. 5,839,500 to Roder et al. issued on Nov. 24, 1998 discloses a method and apparatus for casting a metal slab by a continuous process involving the use of a twin belt caster, moving block caster, or the like. The patent suggests ways of improving the quality of metal castings involving measuring such things as metal temperatures and controlling certain process parameters. However, the patent is not concerned with casting composite ingots and does not involve the supply of two or more metal streams to a casting apparatus.

There is therefore a need for ways of effectively addressing some or all of the problems mentioned above.

SUMMARY OF THE EXEMPLARY EMBODIMENTS

One exemplary embodiment of the invention provides a method of direct chill casting a composite metal ingot, which involves sequentially casting at least two metal layers to form a composite ingot by supplying streams of molten metal to at least two casting chambers within a casting mold of a direct chill casting apparatus, monitoring an inlet temperature of one or more of the streams of molten metal at a position adjacent to an inlet of a casting chamber fed with the stream, and comparing the monitored temperature with a predetermined set temperature for the stream to detect a temperature difference from the set temperature, and adjusting a casting variable that affects molten metal temperatures entering or within the casting chambers by an amount based on the one or more of the detected temperature differences to minimize adverse casting effects caused by the one or more temperature differences.

Preferably, the adjusting of the casting variable is carried out in a manner to cause the monitored inlet temperature of the one or more of the streams to approach or return to the predetermined set temperature for the one or more of the streams. In other words, when a temperature difference from the set temperature is detected, the casting variable is adjusted so that the temperature difference tends to be minimized or eliminated and the monitored temperature approaches or returns to the set temperature.

The adjusting of the casting variable may be stopped at certain stages of casting, for example when the temperature differential is not considered harmful to the casting operation (i.e. does not cause adverse casting effects), or when an adjustment of the casting variable itself causes undesired adverse casting effects. Moreover, the adjusting may be restricted to temperature differentials falling within predetermined ranges so that no adjustment is made for temperature differentials falling outside the predetermined ranges.

Another exemplary embodiment provides an apparatus for casting a composite metal ingot, which includes a direct chill casting apparatus having a casting mold with at least two chambers for casting a composite ingot; troughs for supplying streams of molten metal to the at least two casting chambers; at least one temperature sensor for monitoring inlet temperatures of one or more of the streams of molten metal at positions adjacent to inlets of the casting chambers fed with the streams; a device for comparing the monitored temperatures from the at least one temperature sensor with predetermined set temperatures for the one or more streams to detect temperature differences for the streams; and a controller for adjusting a casting variable that affects molten metal temperatures entering or within the casting chambers by an amount based on a temperature difference detected for at least one of the streams.

The term "casting variable" means a feature of the casting operation that may be varied by the operator (or controlling algorithm operating within a computer or programmable logic controller) during casting. Several casting variables may affect metal temperatures entering or within the mold. For example, such casting variables include ingot casting speed, rate of cooling of the metal layers within the mold, rate of cooling of the composite ingot emerging from the mold, and surface height of the metals within the mold. Variation of casting speed is the preferred variable since it is normally the easiest one to adjust. The effects of variation of the casting speed are explained in more detail below.

The rate of cooling of the metal streams within the mold (i.e. either increased cooling or decreased cooling) may be varied by adjusting the cooling of chilled divider walls used to separate the chambers of the mold. Typically, the divider walls are made of a heat-conductive metal chilled by water flowing through tubes held in physical contact with the divider walls. Adjusting the rate of flow of the cooling water (and/or its temperature) increases or decreases the amount of heat extracted from the divider wall, and thus increases or decreases the heat extracted from, and temperature of, molten metal in contact with the divider wall. Thus, the temperature of the molten metal in contact with the divider wall is adjusted within the mold itself. The metal in contact with the divider wall eventually forms part of the metal interface between adjacent metal layers and thus the amount of cooling the metal receives directly affects the physical characteristics of the metal at the interface (i.e. the temperature and thickness of a semi-solid metal shell formed from the molten metal at the interface). Increasing the rate of flow of water through the tubes attached to the divider wall thus increases the rate of cooling of the molten metal in contact with the divider wall, and thus compensates for a temperature of the molten metal above the intended temperature (set point) as it enters the mold. Conversely, a decrease in the rate of flow of cooling water compensates for a temperature of the molten metal below the set point.

Similarly, the rate at which cooling water is applied to the exterior of the ingot emerging from the mold may increase or decrease the temperature of the metal within the mold because heat is conducted from the metal within the mold along the ingot to the point where heat is withdrawn by the applied external cooling water. Thus, increasing the flow of cooling water (and/or its temperature) produces an increased cooling effect on the molten metal within the mold (thus compensating for temperatures above the set point), and decreasing the flow of cooling water produces a relative reduction of cooling (compensating for temperatures below the set point).

Adjustment of the surface heights of the metal pools within the mold chambers has the effect of varying the metal temperature at the interface where the metals contact each other because greater metal depth within a casting chamber increases the time during which the molten metal is in contact with the chilled mold walls and dividers, and shallower metal depth decreases the cooling time. The metal heights can be adjusted by changing the rate at which molten metal is introduced into the mold chambers, e.g. by moving valves or "throttles" (usually refractory rods) within the metal supply apparatus. Thus, increased metal depth compensates for temperatures above the set point, and decreased metal depth compensates for temperatures below the set point.

One objective of the adjustment of the casting variables is to prevent rupture, collapse or other failure of the interface where the metals of the cast layers first meet. In sequential casting, a newly-formed metal surface made of semi-solid metal is employed as a support on which molten metal for an adjacent layer is cast and cooled. The layer of semi-solid metal is formed as an outer shell around a core of still molten metal, so the shell should be thick enough to avoid rupture or collapse when contacted with the molten metal from the other cast layer. The thickness of the shell is dependent on the time during which the metal layer was cooled, particularly by the divider walls. Furthermore, the temperature of the semi-solid layer should be such that it is not raised into the molten range of temperatures when contacted with the molten metal of the other layer, otherwise the interface may again be subject to rupture or collapse. Thus, the generation of a viable casting interface is very much dependent on the time of cooling and lowest temperature of the first metal to be cast at the point where the cast metals first meet and fully solidify. It is therefore one objective to make adjustments to a casting variable that affects this cooling time and temperature to compensate for fluctuations in the inlet temperatures of the molten metals around the predetermined set point. Another objective of the adjustment of casting variables is to compensate for poor metal flow or the introduction of solid or semi-solid metal artifacts into the casting chambers caused by undue cooling of the metal being introduced. A variable such as casting speed can be used for such compensation as will be apparent from the description below.

A particular feature of the exemplary embodiments is that variations of the inlet temperatures of at least two metal streams are compensated for by the adjustment of just one casting variable, e.g. casting speed, that affects all of the metal layers. The inventors have found that, within predetermined ranges of variation from the set temperatures for the metal streams, a degree of heat transfer takes place across the metal-metal interface to equalize or minimize the effects of the temperature differences of the various metal streams. For example, if the cladding metal is too hot by an amount greater than the core metal, but is still within the predetermined range, a casting speed reduction based on the temperature of the core metal will stabilize the metal-metal interface because the super-heat of the cladding layer will be transferred in part to the core layer and will therefore not have the adverse effect otherwise anticipated. Additional cooling of the cladding metal is therefore not required. It is also possible to adjust the casting variable based on a summation or average of the excess inlet temperatures of both or all of the molten metal streams.

In a particularly preferred exemplary embodiment, a method is provided of direct chill casting a composite metal ingot, which involves sequentially casting at least two metal layers to form a composite ingot by supplying streams of molten metal to at least two casting chambers within a direct chill casting apparatus, monitoring a temperature of each of the streams of molten metal at a position adjacent to one of the casting chambers fed with the stream, and adjusting a predetermined speed of casting, or a predetermined rate of change of speed of casting, based at least one of the inlet temperatures to compensate for detected temperature deviations from set temperatures established for each of the molten metal streams, wherein increased casting speeds are employed to raise the inlet temperatures and decreased speeds are employed to lower the inlet temperatures.

It should also be explained that the terms "outer" and "inner" as employed herein to describe metal layers are used quite loosely. For example, in a two-layer structure, there may strictly speaking be no outer layer or inner layer, but an outer layer is one that is normally intended to be exposed to the atmosphere, to the weather or to the eye when fabricated into a final product. Also, the "outer" layer is often thinner than the "inner" layer, usually considerably so, and is thus provided as a thin coating layer on the underlying "inner" layer or core ingot. In the case of ingots intended for hot and/or cold rolling to form sheet articles, it is often desirable to coat both major (rolling) faces of the ingot, in which case there are certainly recognizable "inner" and "outer" layers. In such circumstances, the inner layer is often referred to as a "core" or "core ingot" and the outer layers are referred to as "cladding" or "cladding layers".

This description also refers to certain alloys by their Aluminum Association "AA" number specifications. These specifications can be obtained from "International Alloy Designations and Chemical Composition Limits for Wrought Aluminum and Wrought Aluminum Alloys", published by the Aluminum Association, Inc., of 1525 Wilson Boulevard, Arlington Va. 22209, USA, revised February 2009 (the disclosure of which publication is specifically incorporated herein by this reference).

BRIEF DESCRIPTION OF THE DRAWINGS

Exemplary embodiments of the invention are described in more detail in the following description with reference to the accompanying drawings, in which.

DETAILED DESCRIPTION

Figure 1:
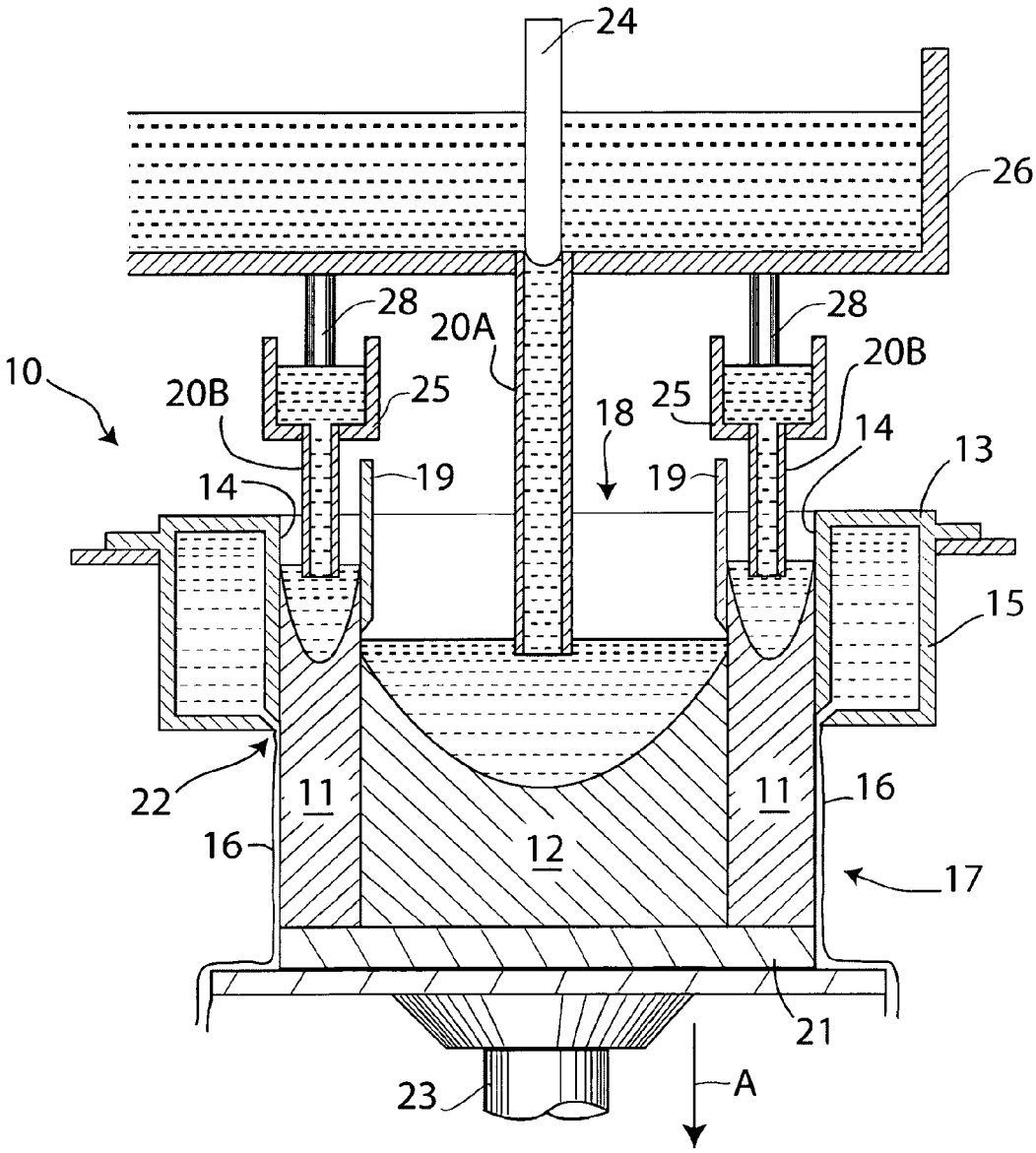
Fig. 1 (Prior Art)
FIG. 1 is a vertical cross-section of a prior art casting apparatus of a kind which may be employed with exemplary embodiments of the invention wherein the so-called "high clad" casting arrangement is shown.
Figure 2:
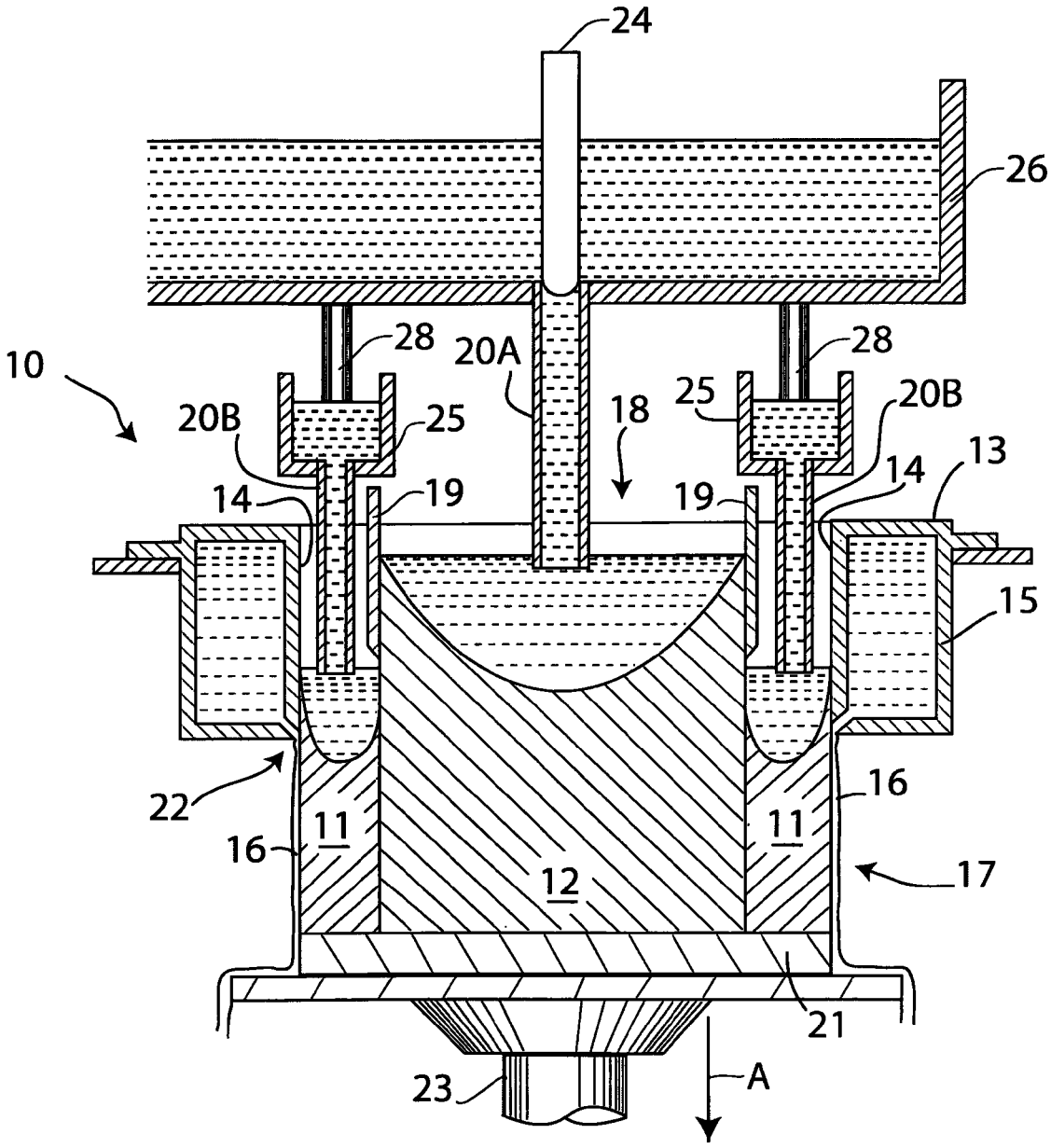
Fig. 2 (Prior Art)
FIG. 2 is a vertical cross-section of a prior art casting apparatus of a kind which may be employed with exemplary embodiments of the invention wherein the so-called "low clad" casting arrangement is shown.
Figure 3:
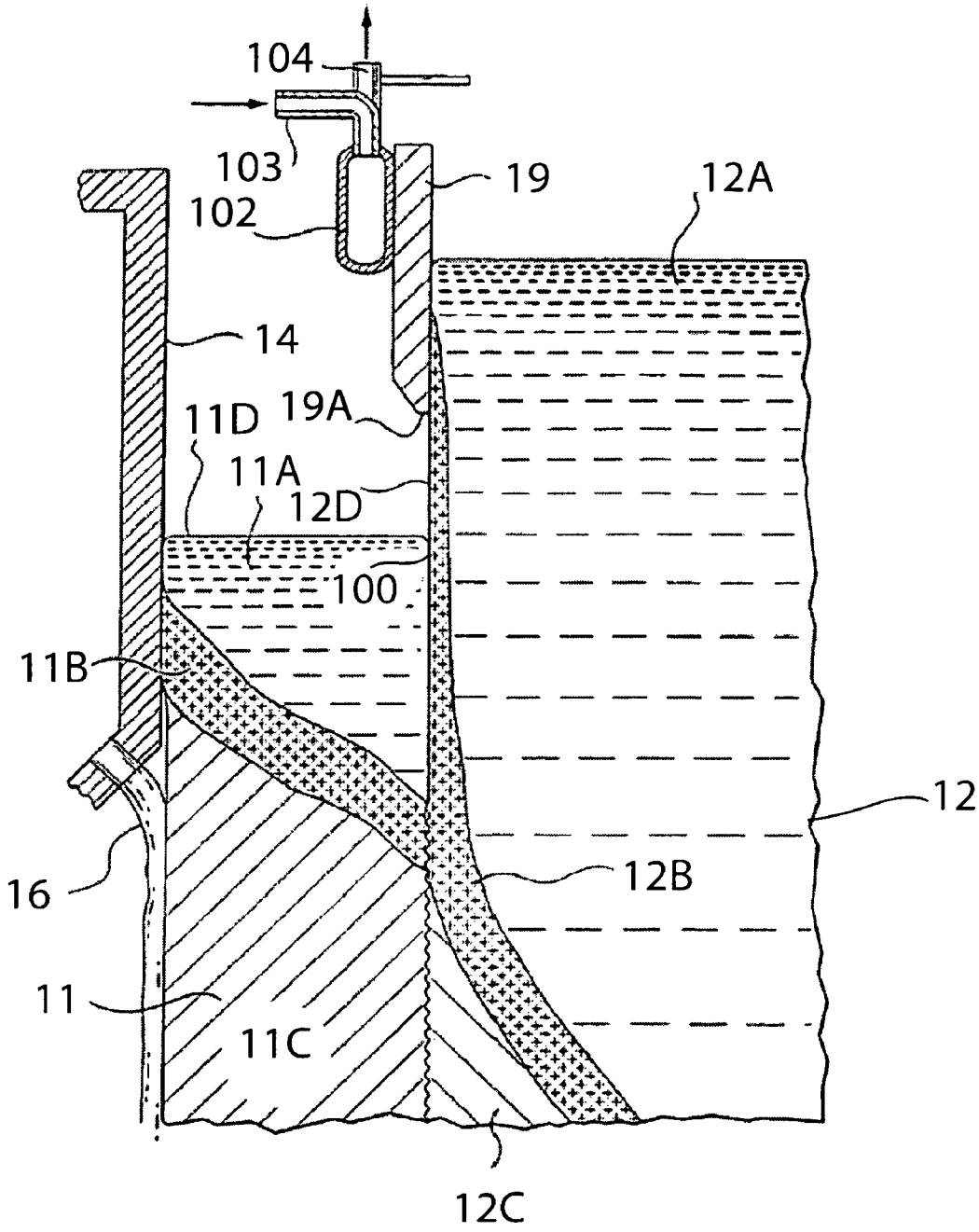
Fig. 3 (Prior Art)
FIG. 3 is an enlargement of the cross-section of FIG. 2 additionally showing equipment for cooling a divider wall and semi-solid regions of the cast ingot.

FIGS. 1, 2 and 3 of the accompanying drawings have been provided to explain examples of the general context within which the exemplary embodiments of the present invention may operate. The figures are vertical cross-sections of composite direct chill casting apparatus of the type disclosed for example in U.S. patent publication US 2005/0011630 A1 published on Jan. 20, 2005 to Anderson et al. (the disclosure of which is specifically incorporated herein by this reference). The invention also extends techniques disclosed in U.S. Pat. No. 6,260,602 to Wagstaff (the disclosure of which is also incorporated herein by this reference). While the following description employs casting speed as the casting variable that affects the integrity of the interface, it should be kept in mind that other casting variables, such as those mentioned above, may be employed instead.

FIG. 1 of the accompanying drawings illustrates a so-called "high clad" (reverse chill) operation of a composite sequential casting apparatus 10 in which the metal pools that form cladding layers 11 have surfaces held at a higher level in the mold than the metal pool that forms a central core layer 12. In contrast, FIGS. 2 and 3 illustrate a so-called "low clad" (normal chill) operation in which the metal pool surfaces for the cladding layers 11 are arranged at lower levels in the mold than the surface for the core layer 12. Whether the apparatus is operated with the "high clad" or "low clad" arrangement depends primarily on the characteristics of the metals being cast (e.g. relative liquidus and solidus temperatures, etc.). When considering FIGS. 1, 2 and 3, it should be noted that composite ingots to which the exemplary embodiments relate do not necessarily have three layers as shown and may consist of just a core layer 12 and one cladding layer 11 on one side of the core layer.

In more detail, FIG. 1 shows a version 10 of the Anderson et al. apparatus used for casting an outer layer (cladding layer or "clad") 11 on both major surfaces (rolling faces) of a rectangular inner layer or core ingot 12. It will be noticed that, in this version of the apparatus, the cladding layers are solidified first (at least partially) during casting and then the core layer 12 is cast in contact with the cladding layers. This arrangement is typical when casting a core alloy having relatively lower liquidus and solidus temperatures than the cladding alloys (e.g. as when the core alloy is an aluminum-based alloy having a high Mg content and the cladding alloys are aluminum-based alloys having low Mg contents or no Mg at all). The apparatus includes a rectangular casting mold assembly 13 that has mold walls 14 forming part of a water jacket 15 from which streams or jets 16 of cooling water are dispensed onto an emerging ingot 17. Ingots cast in this way are generally of rectangular cross-section and have a size of up to 216 cm (85 inches) by 89 cm (35 inches), although constantly improving techniques allow ever larger ingots to be cast. The cast ingots thus formed are usually used for rolling into clad sheet, e.g. brazing sheet, in a rolling mill by conventional hot and cold rolling procedures.

The entry end portion 18 of the mold is separated by upright divider walls 19 (sometimes referred to as "chills" or "chill walls") into three feed chambers, one for each layer of the ingot structure. The divider walls 19, which are often made of copper for good thermal conductivity, and are kept cool by means of water-chilled cooling equipment (described in more detail below with reference to FIG. 3) in contact with the divider walls. Consequently, the divider walls cool and solidify the molten metal that comes into contact with them, as do the water-cooled mold casting walls 14. Each of the three chambers formed in the mold by the divider walls 19 is supplied with molten metal up to a desired level by means of individual molten metal delivery nozzles. The nozzle feeding the core layer is indicated by reference numeral 20A and the nozzles feeding the cladding layers are indicated by reference numerals 20B. Nozzle 20A is equipped with a vertically adjustable throttle 24 that controls the flow of molten metal according to its vertical position. Nozzles 20B do not have such a throttle because the flow of molten metal is controlled at an earlier stage of metal delivery, as will be apparent from the description below. The nozzles 20A and 20B are supplied with molten metal from molten metal delivery troughs 26 and 25, respectively, which deliver the molten metals for the core and cladding layers from metal melting furnaces or other molten metal reservoirs (not shown). This metal delivery arrangement is described in more detail later with reference to FIG. 4. As shown in FIG. 1, a vertically movable bottom block unit 21 supported on a vertical shaft 23 initially closes an open bottom end 22 of the mold, and is then lowered during casting (as indicated by the arrow A) at a controlled rate while supporting the lengthening composite ingot 17 as it emerges from the mold. The apparatus of FIG. 2 works in essentially the same way as the apparatus of FIG. 1, apart from the reversal in relative height of the respective metal pools of the core and cladding layers, which means that the core layer 12 is cast first and the cladding layers 11 are cast onto the partially solidified surfaces of the core layer.

While not fully apparent from FIGS. 1 and 2, FIG. 3 shows that the casting apparatus is operated in such a way that the metals at an interface 100 between core layer 12 and cladding layer 11 are first brought into mutual contact while one of the metals is fully molten (i.e. the metal layer having the lower casting pool surface, in this case the cladding layer 11) and the other is in a semi-solid (or "mushy") condition, or is raised to a temperature within the semi-solid temperature range by contact with the molten metal of the other layer, so that a degree of metal diffusion takes place across the interface, thereby forming a good interfacial bond between the layers in the eventual fully solid ingot. As each metal cools, it changes state from fully molten, to semi-solid and then to fully solid. Thus, the cladding layer has a fully molten region 11A, a semi-solid region 11B and a fully solid region 11C. Likewise, the core layer has a fully molten region 12A, a semi-solid region 12B and a fully solid region 12C. It can be seen that the core layer 12, below the bottom end 19A of divider wall 19, has a shell 12D of semi-solid metal surrounding a molten metal region 12A, and the molten region 11A of the cladding layer, at upper surface 11D, contacts this semi-solid shell. The shell is initially quite thin and relatively fragile and it is important that the shell should not rupture or collapse during casting or casting failure will be caused. Careful control of the metal temperatures is therefore important because the semi-solid zone may exist over quite a short range of temperatures. FIG. 3 also shows equipment for cooling the divider wall 19. This consists of a metal tube 102 contacting the divider wall at a position that is out of contact with the molten metal. The tube is supplied with cooling liquid (usually chilled water) via an inlet pipe 103 and is removed via an outlet pipe 104, as shown by the arrows. As the divider wall is made of a metal of high heat conductivity (e.g. copper), heat is withdrawn through the divider wall from the molten metal and is removed by the cooling water. The molten metal of the core layer 12 adjacent to the divider wall 19 is thus cooled and becomes semi-solid as shown.

In practice, the molten metals used for the core layer and the cladding layer are typically delivered over a significant distance from one or more metal melting furnaces (not shown) via troughs or launders, including generally horizontal troughs 25 and 26 as shown in FIGS. 1 and 2. Because of the distances involved and the difficulties of controlling the temperature and flow of the metal from the furnace(s), temperature variations from desired values can occur when the molten metals are delivered to the chambers of the casting mold during the casting operation.

Figure 4:
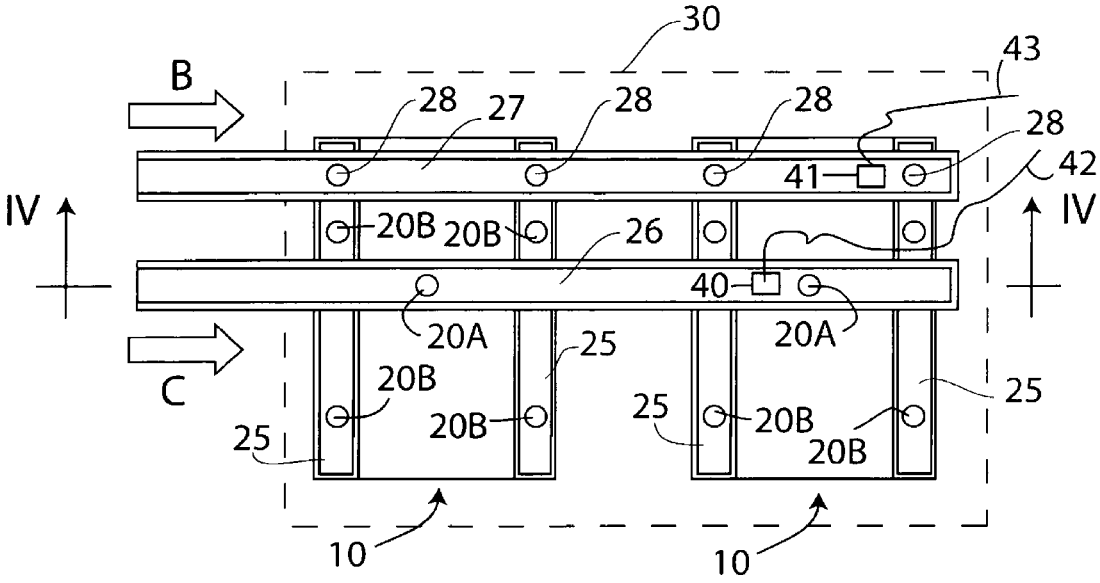
FIG. 4 is a top plan view of a casting table containing two casting apparatuses and showing temperature sensors in metal supply troughs according to an exemplary embodiment of the invention.

As shown in the top plan view of FIG. 4 of the accompanying drawings, it is also typical to supply molten metal to more than one casting mold 10 forming part of a casting table 30 so that more than one composite ingot may be cast at the same time. Generally, the rates of descent of the bottom blocks 21 of each mold in such a table are under the control of a single motor or engine so that the casting speed of all molds forming part of the casting table are necessarily the same. Molten metal for the cladding layers is supplied from a melting furnace in the direction of arrows B via a trough 27 and it is transferred to transverse troughs 25 via downspouts 28. The downspouts 28 are generally supplied with a throttle (not shown, but similar to throttle 24 of FIGS. 1 and 2) to control the metal flow for the cladding layers. From the transverse channels 25, the metal is supplied to the cladding chambers of the casting apparatus 10 via downspouts 20B as already described. Because the downspouts 28 are throttled, the spouts 20B in the transverse troughs 25 are not themselves provided with throttles, as previously mentioned. In this exemplary embodiment, the metals used for both of the cladding layers of the ingot are the same, but different metals may be supplied if desired by providing one or more additional delivery channels. The molten metal for the core layer is supplied from a melting furnace via trough 26 in the direction of arrow C. In this case, the metal is supplied directly to the core chambers of casting apparatus 10 via downspouts 20A provided in the channel. Since, in the illustrated embodiment, the core layers 12 are of much greater volume than the cladding layers 11, the amount of molten metal delivered through channel 26 is much greater than that delivered through channel 27.

In accordance with one exemplary embodiment of the invention, temperature sensors 40 and 41 are provided within channels 26 and 27, respectively, positioned closely adjacent to the most distant downspout 20A or 28 from the furnace in each case. The sensors may be of any suitable type, such as thermometers, thermocouples, thermistors, optical pyrometers, or the like. A currently preferred temperature sensor is a sheathed Type K thermocouple available from Omega Canada of 976 Bergaro St., Laval, Quebec, H7L 5A1, Canada. The sensors dip into the molten metal in the troughs or, in the case of optical pyrometers or other remote sensors, are positioned close to but spaced from the metal. Signal wires 42 and 43 convey the temperature signals to other apparatus, as described with reference to FIG. 5. While the sensors should desirably be positioned as close to the mold inlets (downspouts) as possible, they may in practice be spaced a distance away from the inlets provided there is unlikely to be significant temperature loss during the travel from the sensors to the inlets. When referring to the sensors being adjacent to the mold inlets, such permissible spacing should be kept in mind.

Figure 5:
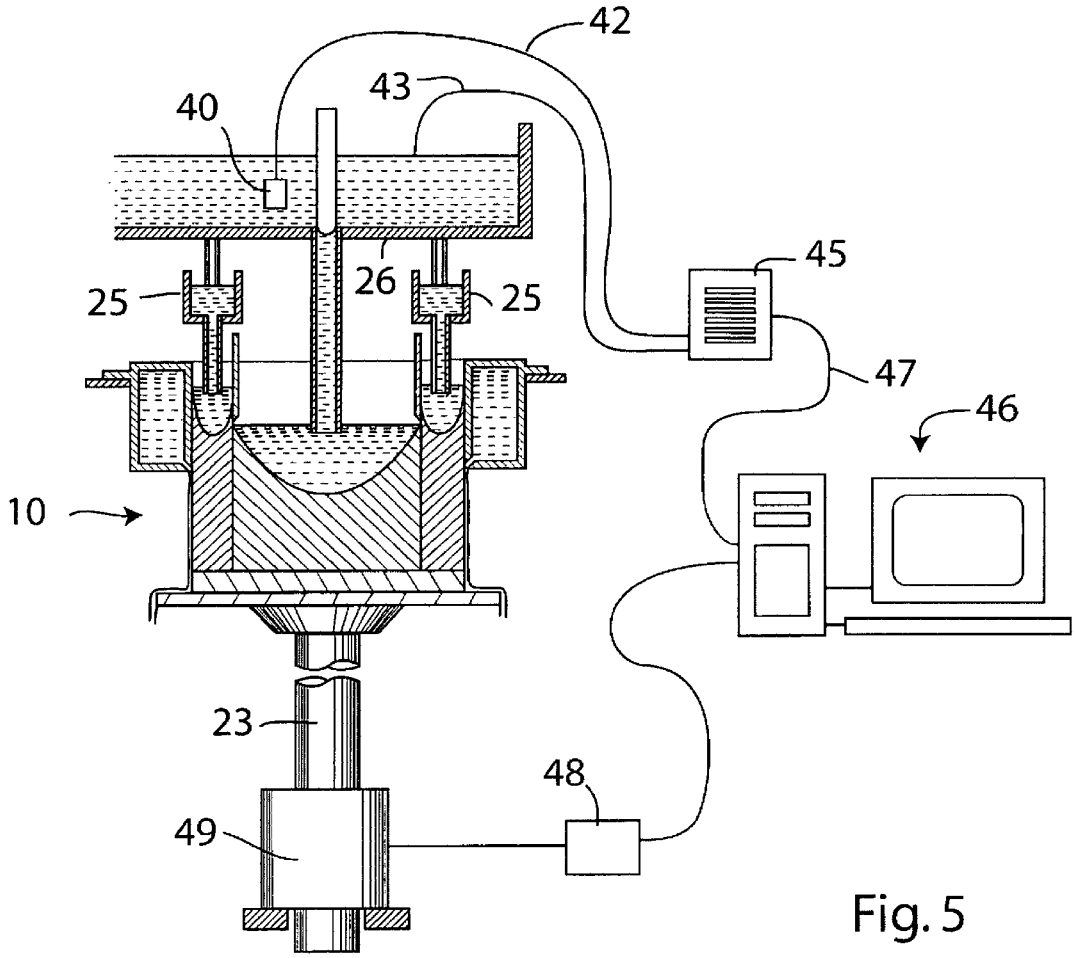
FIG. 5 is a view similar to FIG. 1, but showing apparatus according to an exemplary embodiment of the invention.

In the vertical cross-sectional view of FIG. 5, only one of the temperature sensors (sensor 40 in trough 26) is visible, but the other sensor is present in trough 27 obscured by trough 26. The temperature sensors 40 and 41 are connected via signal wires 42 and 43 to a temperature measuring device 45 that converts the sensed temperatures into digital signals that are fed to a programmable logic controller (PLC) or computer 46 via a cable 47. The PLC or computer 46 uses the incoming temperature information to calculate an appropriate casting speed, or an appropriate adjustment of a predetermined casting speed, that will operate to minimize variations from predetermined set temperatures for the molten metals as sensed by the sensors 40 and 41. The computer 46 then delivers a signal encoding the desired casting speed or speed variation to a controller 48 for a casting speed actuator 49 (controller 48 thus regulates the speed of downward movement of the bottom block during casting). While actuator 49 is shown only in a schematic way in FIG. 5, it will typically employ hydraulically actuated cylinders that rely on flow of hydraulic fluid from a pump through a control valve. The actuator 49 initially raises the bottom block 21 up to the starting position in which it closes the lower mold opening. However, during the cast, the hydraulic pressure is gradually released and gravity moves the bottom block 21 down. The controller 48 therefore regulates the rate at which the hydraulic pressure is released to control the speed of ingot descent. In turn, this governs the rate at which the metals flow through the casting apparatus 10, and hence the rate at which the metals flow through troughs 25, 26 and 27 (assuming that throttle 24 and other throttles are not adjusted). Thus, an increase in the casting speed increases the rate of molten metal flow into the casting apparatus, and a decrease of the casting speed decreases the rate of meal flow into the casting apparatus. Generally, an increase of the rate of metal flow into the casting apparatus causes the temperature of the metal entering the casting apparatus to increase because it has less time to cool within the delivery troughs and spouts. Conversely, a decrease of the metal flow rate causes a reduction of the temperature of the metal entering the casting apparatus because of increased delivery times and consequent cooling. Additionally, slowing the casting speed will tend to make the interface 100 more robust for several reasons, including increased contact time of the molten metal with the cooled mold walls 14, divider walls 19 and eventually the water jets 16, which increases the shell thickness of the semi-solid metal at the interface 100.

In those cases where there is more than one casting mold in a casting table, i.e. as shown in FIG. 4 where there are two such molds but there are typically three, the casting speed of each mold is adjusted in the same manner. It is assumed that, if there are variations of metal temperature from preferred set points at the ends of channels 26 and 27 where the sensors 40 and 41 are located, then there will be corresponding variations of temperature at positions in the channels adjacent to the downspouts leading to each of the other casting moulds. It is pointed out, however, that instead of (or as well as) controlling casting speed by causing the bottom block to descend at a rate that affects all of the casting molds in the same way, the heights of the metal levels in the casting chambers may be caused to differ from one casting apparatus to another to thereby optimize the casting conditions for the particular temperatures of the molten metals introduced into the individual molds.

Casting operations of this kind normally have different casting stages for which the casting speed differs, even without the adjustments of the exemplary embodiments. For example, there is normally a start-up stage when the casting speed is quite low and often does not vary. This is followed by an acceleration stage where the speed is gradually increased up to the preferred casting speed. Then there is a normal casting stage, often referred to as the run stage or steady-state stage, where the speed is held at the preferred casting speed until the bulk of the ingot has been cast. At the end of the run stage, the supply of molten metal is simply terminated. The sensed metal temperatures of the exemplary embodiments may be used in different ways in these different casting stages. For example, the range of speed variation or adjustment from the predetermined casting speed (the so-called target speed) may be different in the different casting stages, and the sensed temperature of the cladding metal may be employed for determining casting speed variations in one stage, whereas the sensed temperature of the core metal may be used in another stage, or in some stages both may be used. Furthermore, it is to be noted that high clad arrangements may be treated differently from low clad arrangements, and different metal combinations may require different treatments from other metal combinations.

It can be determined empirically or by computer modelling which treatment works best for each of the various different arrangements (high clad, low clad, particular metal combinations, casting stages, etc.). The best treatment is one that minimizes or eliminates casting failures due to temperature-dependent ruptures or breaches of the metal-metal interface. However, the following principles are preferably used to determine the ways in which the sensed temperatures are used to vary the casting speeds according to the exemplary embodiments:

1) A target casting speed can be determined for all casting stages based on previously used casting speeds, or can be determined empirically.

2) A temperature set point can be determined, from prior known operations or empirically, for each of the core metal and cladding metal at the entry into the casting apparatus, this being the preferred temperature for casting that produce an optimized clad metal ingot. The temperature set point is often a known or predetermined offset from the liquidus temperature of the metal.

3) Variations of temperature from the set points can be controlled (moved back towards the set points) by casting speed adjustments, but only up to a certain maximum or minimum (establishing the temperature compensation range) determined by known or empirically-determined permissible variations of the target casting speed.

4) Temperature control is most important during the run stage of casting but may also be carried out during one or both of the start-up stage and the acceleration stage, and preferably there is some degree of temperature control by casting speed compensation during all stages of casting.

5) Sensed temperature variations may be ignored, either over all or just part of the temperature compensation range, if variations likely to be encountered are established not to be harmful to the cast ingot in one or more stages of casting.

6) Either the temperature of the core metal or the temperature of the clad metal, or both, may be used to generate compensatory casting speed changes, and the reliance on the clad metal temperature, core metal temperature, or both, may be changed during different stages of casting according to which temperature is considered to be the one to which the metal interface is the most sensitive (i.e. the one most likely to cause interface failure).

7) There may be a maximum rate of change of the casting speed for any apparatus that should preferably not be exceeded in any casting stage.

8) The temperatures should preferably be measured at or close to the point where the metal enters the casting mold (but distances irrelevant to temperature change may be permitted).

9) If there is more than one casting mold being fed by metal through common channels, the temperature should preferably be measured at or close to the point where the metal enters the most distant mold from the source of molten metal (most preferably just upstream of that point).

10) Generally, the change of sensed temperature is linked linearly to the compensating change of casting speed, but one of the sensed temperatures may be used to produce a greater (or lesser) compensating change of casting speed than the other.

(11) Casting speed variations may often be in the range of ±10 mm/min, and more preferably ±6 mm/min. However, for certain alloy combinations or types of casting equipment, higher casting speed variations may be contemplated.

(12) Temperature variations that may be compensated for by the casting speed adjustments may be as high as ±60° C. around the set point, more generally ±35° C. In many cases, however, the temperature variations are much lower, e.g. ±10° C. or even ±6° C., or less (e.g. ±3° C.), around the set point.

These principles, and the manner in which they are used, will become more apparent from the Examples below and corresponding FIGS. 5 and 6 of the accompanying drawings.

EXAMPLES

Figure 6:
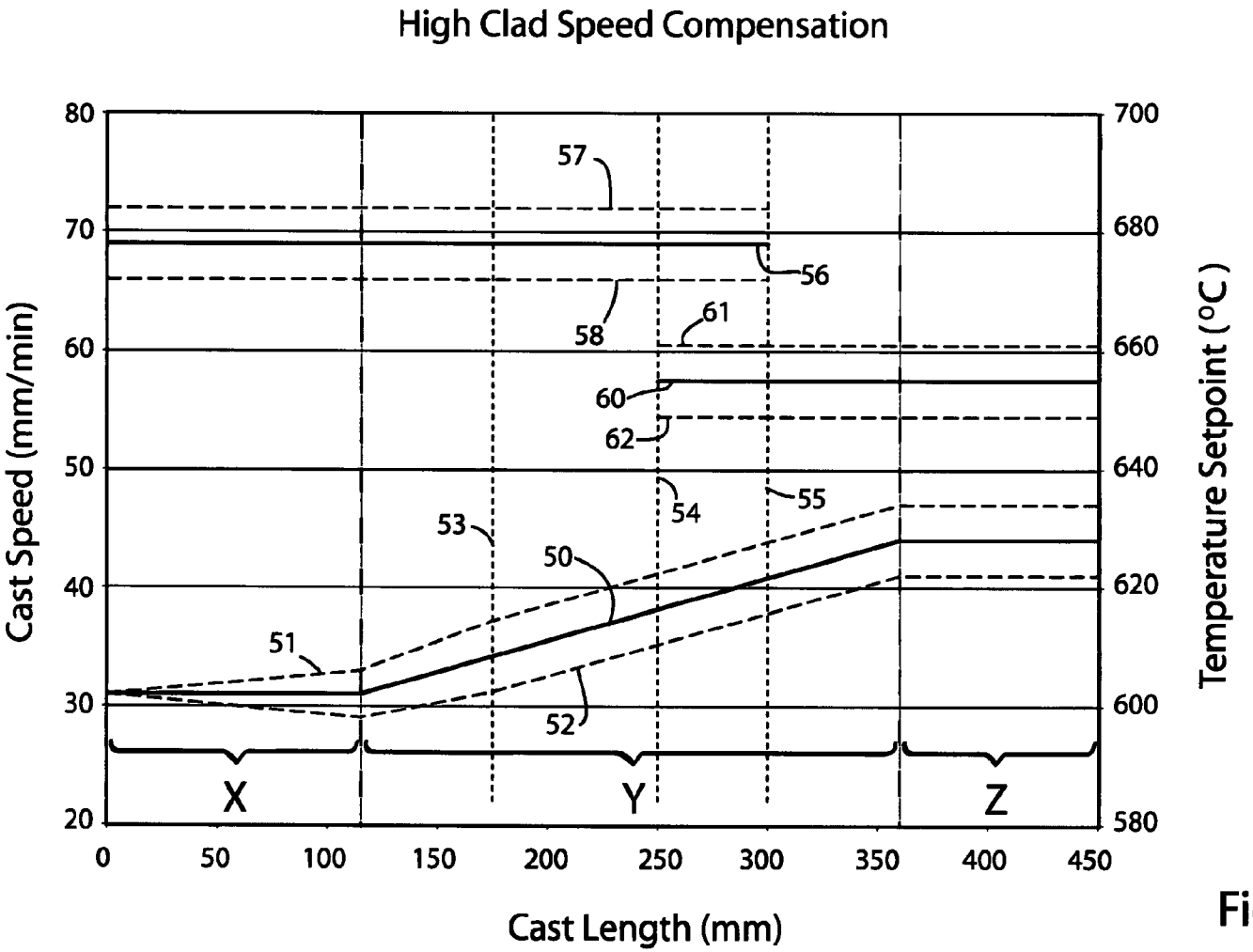
FIGS. 6 and 7 are graphs showing temperature and casting speed variations during casting operations carried out with a "high clad" casting arrangement (FIG. 6) and a "low clad" casting arrangement (FIG. 7).
Figure 7:
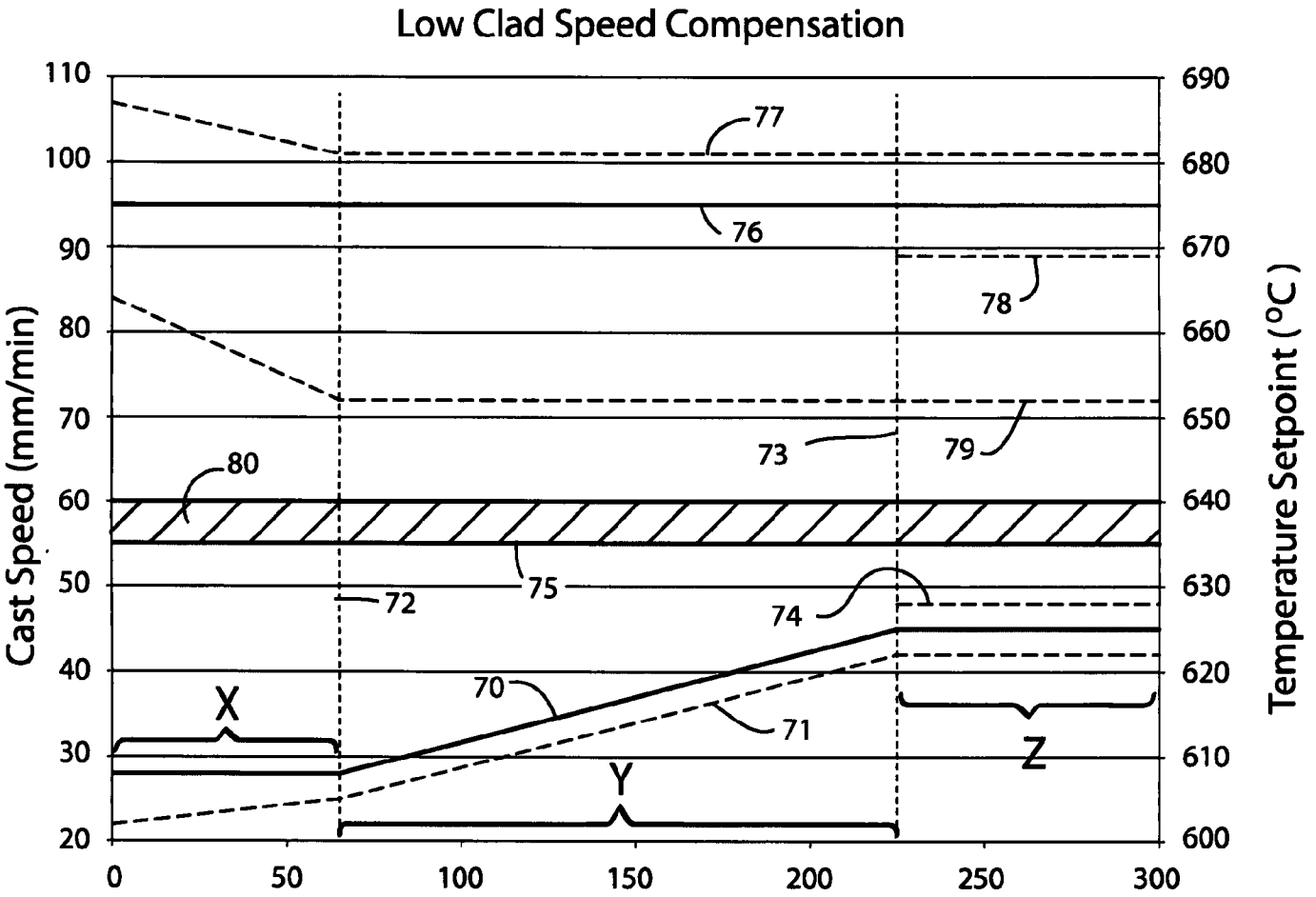

Examples of the way in which the casting speed can be adjusted, and on which an associated computer algorithm was based, are shown in FIGS. 6 and 7, where FIG. 6 shows the situation for a high clad casting arrangement and FIG. 7 shows the situation for a low clad casting arrangement. FIG. 6 involved the casting of a core of proprietary AA5000 series aluminum-based alloy containing about 6% by weight Mg, with two cladding layers of another proprietary AA5000 series aluminum-based alloy containing about 1% by weight Mg. FIG. 7 involved the casting of a core of AA3000 series aluminum-based alloy and two cladding layers of proprietary AA4000 series aluminum-based alloy, which resulted in an ingot later rolled to produce a brazing sheet product. Although the measured temperatures and adjusted casting speeds are not shown in these drawings, they varied within the indicated limits. That is to say, an adjustment of the casting speeds resulting from variations of the inlet temperatures from the set points caused the inlet temperatures to return towards the set points.

FIG. 6 is a graph showing the length of the cast ingot from the mold outlet (cast length) on the abscissa, casting speed (cast speed) on the left hand ordinate (the speed of movement of the bottom block), and temperature (Temperature Set Point) on the right hand ordinate. Although the casting length on the abscissa ends at 450 mm, the full length of the cast ingot is longer (e.g. 3 to 5 m), but the casting conditions do not change beyond the 450 mm limit so the graph was terminated there. Curve 50, shown as a solid line, represents a "target" casting speed, which was the intended or base casting speed in the absence of any speed compensation according to exemplary embodiments of the invention. The target casting speed was known from prior experience for the particular casting apparatus and metal combination. As is typical of such casting operations, there were different casting stages and the target casting speed was made different in the different stages. When casting was commenced (at ingot length 0 mm) there was a start-up stage shown by bracket X during which the bottom block 21 was moved downwardly from the mold outlet. The target speed for such movement was constant at 31 mm per minute. After a time (e.g. less than about 4 minutes, at an ingot length of about 110 mm), the casting operation entered a second stage (an acceleration stage shown by bracket Y) during which the target casting speed was continually increased until it reached a maximum speed of about 43 mm/min (the target casting speed for the next stage) at an ingot length of just above 350 mm. In the third casting stage (the run stage indicated by bracket Z), the target speed was kept the same (at 43 mm/min) throughout the rest of the casting operation.

For any target casting speed, a maximum safe speed adjustment was pre-determined, i.e. either an increase or a decrease in the target casting speed, that could be employed without causing detriment to the cast ingot. Beyond the maximum safe speed adjustment (either an increase or a decrease) experience showed that there was a risk that some harmful or undesired effects may be caused, e.g. if the target casting speed was increased too much, the large faces of a rectangular ingot (the so-called rolling faces) might become unduly concave and, conversely, if the target casting speed was decreased too much, the large faces might become unduly convex. These maxima represent the limits of the target speed adjustments or compensations employed in the exemplary embodiments, i.e. they represent the maximum compensated speed and the minimum compensated speed for any stage of casting and they are determined empirically or from a range considered reasonable by the skilled operator.

In FIG. 6, the maximum compensated speed is shown by dashed line 51 and the minimum compensated speed is shown by dashed line 52. The distance between these lines is considered to be the effective safe speed compensation range, and it will be seen that this range increases from zero at the start of casting to a maximum at vertical line 53. Beyond line 53, the speed compensation range does not change significantly, although the target casting speed changes in the acceleration stage Y.

In the casting apparatus that provided the results of FIG. 6, there were two sets of water cooling jets 16 (see FIG. 1) arranged at different angles to the surfaces of the cast ingot and separately operable. A first set of jets orientated at 22° to the ingot surface was operated from the start of casting at a low flow rate to reduce so-called "butt-curl" (distortion of the bottom end of the ingot due to thermal stresses). The flow was increased as the casting speed increased in the acceleration stage. At a certain point, a valve switched on a second set of jets orientated at 45° to the ingot surface. Vertical line 53 represents a position on the growing ingot that is 25 mm before the valve opening of the second set of jets, vertical line 54 represents a position 25 mm after the valve opening ends and vertical line 55 represents a position 75 mm after the valve opening ends. These are considered significant positions in the casting sequence of this operation.

Early in the casting sequence, only the temperature sensed by the temperature sensor 41 for the molten metal for the clad layers was used for generating speed compensations. The temperature of the molten metal for the cladding had a preferred temperature referred to as the clad temperature set point as shown at 56 in FIG. 6. This is the most desirable temperature for the cladding metal to provide a good metal-metal interface and other desirable characteristics. This temperature set point was already known for the particular casting equipment and metal combination, but could have been determined empirically. FIG. 6 shows a maximum effective temperature for the cladding metal indicated by dashed line 57 above set point line 56 and a minimum effective temperature for the cladding metal indicated by dashed line 58 below set point line 56. The distance between these lines represents the effective clad temperature adjustment range. The maximum effective temperature is the maximum to temperature that can be caused to decrease by adjusting (in this case slowing) the casting speed within the compensated speed range, and the minimum effective temperature is that which can be caused to increase by adjusting (in this case increasing) the casting speed within the compensated speed range. Beyond this temperature range, other measures may have to be employed to move the clad metal temperature back towards the clad temperature set point. For example, trough heaters (if present) can be turned on or off, insulating trough covers (if present) may be raised or lowered, etc. Such measures are not generally capable of the fine temperature control that can be achieved by casting variable compensation according to the exemplary embodiments, and are thus reserved for large temperature variations that cannot be controlled by those methods.

In the exemplary embodiment, while relying only on the clad metal temperature measurement during this early part of the casting sequence, the computer 46 speeds up the casting when the sensed temperature falls below the setpoint 56 and slows down the casting when the sensed temperature rises above the setpoint 56. The change in speed compared to change in temperature is generally a linear function so that the speed change reaches its maximum or minimum as the temperature variation reaches its minimum or maximum. For example, for the apparatus that produced the results of FIG. 6, changes of the cladding temperature from the set point caused casting speed compensations at a rate of 0.5 mm per minute per degree Centigrade (Celcius). In the region from the start of casting until line 53, the maximum compensation range increased from 0 to ±3 mm/min at line 53 (25 mm before valve opening). In the region between lines 53 and 54, the maximum compensation range remained constant at ±3 mm/minute. However, for most casting apparatus, a change in speed should not exceed a certain maximum value, so that an instantaneous change in temperature from the set point to the minimum or maximum will not produce an instantaneous change in the casting speed from the target to the maximum or minimum. Instead, the speed will change more slowly until the maximum or minimum is reached. This lag in speed compensation in following the temperature variations is provided to prevent abrupt speed changes. The maximum speed change for the apparatus that produced the results of FIG. 5 was 0.2 mm/second.

As can be seen from FIG. 6, the reliance on the clad temperature continued only until the length of the ingot reached line 55, and then the clad temperature was no longer used to generate speed compensations. Instead, beyond line 55, the core temperature measured by sensor 40 was solely relied on for speed compensations. As with the clad metal, the core metal had a preferred temperature (set temperature) 60 and maximum and minimum temperatures around the set temperature 60 (shown by dashed lines 61 and 62, respectively) within which the temperature could be returned towards the set temperature by casting speed variations. In this region, the core temperature causes casting speed variations at a rate of 0.5 mm per minute per ° C. with the maximum compensation being ±3 mm/min.

It is apparent from FIG. 6 that there is a region of overlap of the temperature set points from the two sensors between vertical lines 54 and 55 where both the clad temperature and the core temperature were used to generate compensations in the casting speed. In this region, the compensation transitioned linearly from 100% clad-based/0% core-based to 0% clad-based/100% core based (this was done to ensure a smooth transition from clad-based-only to core-based-only compensations). Thus, half way through this region, 50% of the compensation calculated for the clad was added to 50% of the compensation calculated for the core metal.

FIG. 7 shows an effective scheme for a casting mold operated with low cladding levels. In this casting example, unlike that of FIG. 6, both water jets were opened from the start of casting, which is appropriate for the types of metal being cast. Again, the target casting speed 70 varied from a low but constant speed at start-up (bracket X), an increasing speed during the acceleration stage (bracket Y), and constant but higher speed during the normal casting run stage (bracket Z). As with the example of FIG. 6, the length of the ingot was ultimately greater than the 300 mm shown, but casting conditions did not change beyond this point so the graph was terminated here. The minimum casting compensation speed is shown by dashed line 71, and decreases from minus 6 mm/min (from target) at the start of casting (length 0) to minus 3 mm/min at the end of the start-up stage X (vertical line 72). The minimum then remains constant at −3 mm/min for the remaining casting stages. Unlike FIG. 6, there was no permitted speed compensation increase from the target casting speed 70 during the start-up stage X and the acceleration stage Y. In the run stage Z, starting at vertical line 73, the maximum increase in compensation was +3 mm/min as shown by dashed line 74.

The cladding metal had a clad metal temperature set point indicated by solid line 75. The core metal had a core metal set point indicated by solid line 76. In this example, the core metal set point was higher than the clad metal set point, as shown. The core metal had a maximum temperature up to which increases in core temperature could be controlled by compensations to the casting speed, as shown by dashed line 77. The minimum core metal temperature is shown by dashed line 78, but only in the run stage Z of the casting operation. This means that core temperature decreases below the core temperature set point in the start-up and acceleration stages were not compensated for by variations of casting speed, and this corresponds to the lack of positive compensation of casting speed in these stages (as mentioned above). This is because speed increases are considered too harmful for this alloy combination early in the casting operation.

The cladding metal had a maximum temperature above the set point for all stages as shown by dashed line 79. Temperature increases up to this maximum could be controlled by a corresponding decrease of the casting speed. As shown, this maximum decreases from a high value at the start of casting to a lower value at the end of the start-up stage X and then remains at a constant value through the acceleration and run stages. However, for all casting stages, there was a "deadband" shown by cross-hatched region 80 immediately above the clad metal set point 75 extending up to a temperature below the maximum clad metal temperature 79. This deadband 80 represents a region where increases of temperature from the clad set point were not used to generate compensatory changes in the casting speed. Therefore, only clad metal temperatures above this deadband 80, but below the maximum 79, were used to generate casting speed changes. This is because small increases in the clad metal temperature (those falling within the deadband 80) did not adversely affect the cast ingot and could thus be tolerated without casting speed compensation.

It will be noticed that the clad metal had no minimum temperature range shown below the set point 75 in any of the casting stages. This is because speed increases were considered too harmful for this alloy combination early in the casting operation (again, this corresponds to the lack of increased casting speed compensation, at least in the first two stages X and Y).

In this embodiment, the temperatures of both the core and the cladding metal were employed for casting speed adjustment throughout all stages of casting (although some temperature variations were ignored, as indicated above). In the start-up and acceleration stages X and Y, increases of the core temperature were compensated for by reductions of casting speed at a rate of 0.5 mm per minute per ° C. Cladding temperature increases (above the deadband 80) were compensated for at a rate of 0.25 mm per minute per ° C. These rates were treated as additive (or subtractive, if they are of different sign, i.e. speed increases are negated by speed decreases, and vice versa). During the run stage, both core metal temperature and cladding metal temperature were used to generate casting speed compensations, but only temperature rises of the clad metal above the deadband 80 were employed (clad metal temperature falls were ignored), whereas both temperature rises and temperature falls of the core metal were used for casting speed compensations. Core metal temperature increases and falls caused compensation at a rate of 0.5 mm per minute per ° C. Clad metal temperature increases above the deadband caused casting speed compensations at a rate of 0.25 mm per minute per ° C. The changes were added or subtracted according to whether the temperature changes are positive or negative relative to the set points.

In the apparatus that produced the results shown in FIG. 7, the maximum permitted rate of change of the casting speed was 0.2 mm/min per second.

It will be appreciated by persons skilled in the art that various modifications and alterations of the above details may be made to compensate for different conditions, equipment and metal combinations without departing from the scope of the following claims.

What is claimed is:

1. A method of direct chill casting a composite metal ingot, which comprises:

sequentially casting at least two metal layers to form a composite ingot by supplying streams of molten metal to at least two casting chambers within a casting mold of a direct chill casting apparatus;

monitoring inlet temperatures of at least two of said streams of molten metal at positions adjacent to inlets of casting chambers fed with said at least two streams, and comparing said monitored temperatures with predetermined set temperatures for said at least two streams to detect temperature differences from said set temperatures for each of said at least two streams; and adjusting a casting variable that affects molten metal temperatures entering or within the casting chambers by an amount based on a combination of said detected temperature differences to produce a single value used for adjusting said casting variable to minimize adverse casting effects caused by said one or more temperature differences.

2. The method of claim 1, wherein said adjusting of said casting variable is carried out in a manner to cause said monitored inlet temperatures of said at least two of said streams to approach said predetermined set temperatures for each of said at least two of said streams.

3. The method of claim 1, wherein said casting variable is selected from the group consisting of ingot casting speed, rate of cooling of said streams within said mold, rate of cooling of said composite ingot emerging from said mold, and surface height within said mold of at least one of said molten metals.

4. The method of claim 1, wherein said casting variable is ingot casting speed.

5. The method of claim 4, wherein only adjusting of said casting speed within predetermined limits established to avoid casting deficiencies is employed.

6. The method of claim 1, wherein said sequential casting has at least two stages of casting defined by differences of casting speed, and wherein said adjusting of said casting variable is carried out in at least one of said stages.

7. The method of claim 6, wherein said adjusting of said casting variable is carried out in at least two of said stages.

8. The method of claim 1, wherein the casting mold is one of at least two casting molds arranged within a casting table, and wherein said monitored inlet temperatures of said at least two molten metal streams supplied to said one casting mold are used as a basis for adjusting said casting variable of all of said molds.

9. The method of claim 1, wherein said temperature differences for said at least two streams are employed for adjusting said casting variable only when said temperature differences fall within a range of ±60° C. of said set temperatures.

10. The method of claim 1, wherein said temperature differences for said at least two streams are employed for adjusting said casting variable only when said temperature differences fall within a range of ±10° C. of said set temperatures.

11. The method of claim 1, wherein said temperature differences for said at least two streams are employed for adjusting said casting variable only when said temperature differences fall within a range of ±6° C. of said set temperatures.

12. The method of claim 1, wherein metals supplied for said metal layers are aluminum-based alloys.

13. The method of claim 1, wherein said streams of molten metal are supplied through troughs, and wherein said temperatures are monitored within said troughs.

14. The method of claim 1, wherein said single value is obtained by a summation of said temperature differences.

15. The method of claim 1, wherein said single value is obtained by producing an average of said temperature differences.

* * * * *